US009881547B2

(12) United States Patent
Eom

(10) Patent No.: US 9,881,547 B2
(45) Date of Patent: Jan. 30, 2018

(54) ORGANIC LIGHT-EMITTING DIODE (OLED) DISPLAY AND METHOD OF DRIVING THE SAME

(71) Applicant: Samsung Display Co., Ltd., Yongin, Gyeonggi-do (KR)

(72) Inventor: Cheolhwan Eom, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 149 days.

(21) Appl. No.: 14/635,914

(22) Filed: Mar. 2, 2015

(65) Prior Publication Data

US 2016/0098957 A1 Apr. 7, 2016

(30) Foreign Application Priority Data

Oct. 2, 2014 (KR) ..... 10-2014-0133551

(51) Int. Cl.
*G09G 3/30* (2006.01)
*G09G 3/3225* (2016.01)

(52) U.S. Cl.
CPC ... *G09G 3/3225* (2013.01); *G09G 2320/0257* (2013.01); *G09G 2320/0276* (2013.01); *G09G 2320/041* (2013.01); *G09G 2330/12* (2013.01); *G09G 2360/16* (2013.01)

(58) Field of Classification Search
CPC ..... G09G 3/3258; G09G 2320/0257; G09G 2320/041
See application file for complete search history.

(56) References Cited

U.S. PATENT DOCUMENTS

2004/0061670 A1* 4/2004 Muruyama ..... G09G 3/3216 345/76
2009/0184901 A1* 7/2009 Kwon ..... G09G 3/3233 345/77
2011/0273422 A1* 11/2011 Park ..... G09G 3/3233 345/211
2011/0298782 A1 12/2011 Park
2012/0139955 A1* 6/2012 Jaffari ..... G06F 17/5018 345/690

(Continued)

FOREIGN PATENT DOCUMENTS

KR 10-2000-0015729 A 3/2000
KR 10-2005-0081370 A 8/2005

(Continued)

*Primary Examiner* — Carolyn R Edwards
*Assistant Examiner* — Scott Au
(74) *Attorney, Agent, or Firm* — Knobbe, Martens, Olson & Bear, LLP

(57) ABSTRACT

An organic light-emitting diode (OLED) display and a method of driving the same are disclosed. In one aspect, the OLED display includes a display panel including a plurality of pixels and a plurality of sensing regions. The OLED display further includes a temperature sensor array comprising a plurality of temperature sensors respectively arranged on the sensing regions. The OLED display also includes a controller configured to output a plurality of control signals so as to sequentially select the temperature sensors, receive a plurality of output signals output from the temperature sensors selected by the control signals, and generate first temperature data corresponding to the locations of the selected temperature sensors based on the output signals.

10 Claims, 8 Drawing Sheets

(56) References Cited

U.S. PATENT DOCUMENTS

2013/0249932 A1* 9/2013 Siotis ..... G09G 3/20
345/589

FOREIGN PATENT DOCUMENTS

| | | | |
|---|---|---|---|
| KR | 10-2007-0115494 | A | 12/2007 |
| KR | 10-2008-0048163 | A | 6/2008 |
| KR | 10-2011-0067356 | A | 6/2011 |
| KR | 10-2011-0133350 | A | 12/2011 |

* cited by examiner

ORGANIC LIGHT-EMITTING DIODE (OLED) DISPLAY AND METHOD OF DRIVING THE SAME

RELATED APPLICATION

This application claims the benefit of Korean Patent Application No. 10-2014-0133551, filed on Oct. 2, 2014, in the Korean Intellectual Property Office, the disclosure of which is incorporated herein in its entirety by reference.

BACKGROUND

Field

The described technology generally relates to an organic light-emitting diode (OLED) display and a method of driving the same.

Description of the Related Technology

Flat panel displays such as liquid crystal displays (LCDs) or OLED displays are suitable for smaller form factors defined by portable electronic devices and for large-sized screens or high resolution screens.

An OLED display displays images by using OLEDs that emit light via the recombination of electrons and holes. OLED displays include a plurality of pixels arranged at the intersections between a plurality of scan lines and a plurality of data lines.

SUMMARY OF CERTAIN INVENTIVE ASPECTS

One inventive aspect is an OLED display that can sense temperature, and a method of driving the OLED display.

Additional aspects will be set forth in part in the description which follows and, in part, will be apparent from the description, or may be learned by practice of the presented embodiments.

Another aspect is an OLED display including a display unit on which a plurality of pixels are formed and a plurality of sensing regions are defined; a temperature sensor array including a plurality of temperature sensors arranged respectively on the plurality of sensing regions corresponding to the plurality of temperature sensors; and a control unit outputting control signals for selecting one of the plurality of temperature sensors, receiving output signals output from temperature sensors selected by the control signals, and generating first temperature data corresponding to locations of selected temperature sensors based on the output signals.

The OLED display may further include an amplifier for amplifying the output signals output from the plurality of temperature sensors and outputting amplified output signals to the control unit.

Each of the temperature sensors may include a temperature variable resistor, a resistance value of which is changed according to temperature.

The OLED display may further include a switch array comprising a plurality of switches that are respectively connected to the plurality of temperature sensors and turned on/turned off by the control signals.

The OLED display may further include a power supply unit for supplying a constant voltage to the temperature sensor array, wherein the switch array may further include a fixed resistor connected to the plurality of switches and having a constant resistance value, and the output signal corresponds to a magnitude of a voltage across the temperature sensor selected by the control signal.

The OLED display may further include a power supply unit for supplying a constant current to the temperature sensor array, wherein the output signal may correspond to a magnitude of a voltage across the temperature sensor selected by the control signal.

The plurality of temperature sensors may be selected in a predetermined order by the control signals and output the output signals to the control unit.

A plurality of intermediate regions may be further defined between the plurality of sensing regions, and the control unit may generate second temperature data corresponding to the plurality of intermediate regions based on the first temperature data.

The OLED display may further include an amplifier for amplifying the output signals, wherein the control unit may receive amplified output signals output from the amplifier, convert the amplified output signals into digital values, generate temperature values corresponding to the digital values, and generate the first temperature data by matching the temperature values with locations of sensing regions corresponding to the selected temperature sensors.

The OLED display may further include a memory storing a lowest digital value corresponding to a lowest temperature value and a highest digital value corresponding to a highest temperature value, wherein the temperature value may be calculated based on the digital values, the lowest temperature value, the lowest digital value, the highest temperature value, and the highest digital value.

The temperature sensor array may include: a first flexible printed circuit board (FPCB) base film attached to a rear surface of the display unit; a plurality of thermistors arranged on the first FPCB base film; and a second FPCB base film arranged on the first FPCB base film for covering the plurality of thermistors.

The OLED display may further include a correcting unit performing at least one of an image sticking compensation (ISC) and a real-time gamma correction (RGC) by using the first temperature data.

According to one or more exemplary embodiments, a method of driving an OLED display including a display unit, on which a plurality of pixels are formed and a plurality of sensing regions are defined, the method includes: outputting control signals for selecting one of a plurality of temperature sensors that are respectively arranged on the plurality of sensing regions corresponding thereto; receiving output signals output from temperature sensors selected by the control signals; and generating first temperature data corresponding to locations of selected temperature sensors based on the output signals.

Each of the temperature sensors may include a temperature variable resistor, and the plurality of temperature sensors work selectively by the control signals.

The method may further include supplying electric power to the plurality of temperature sensors, wherein the control signals may determine turning on/turning off states of a plurality of switches that are respectively connected to the plurality of temperature sensors, and each of the output signals may correspond to a magnitude of a voltage across the temperature sensor selected by each of the control signals.

The control signals may select the plurality of temperature sensors in a predetermined order.

A plurality of intermediate regions may be further defined between the plurality of sensing regions on the display unit, and the method may further include generating second temperature data corresponding to the plurality of intermediate regions based on the first temperature data.

The method may further include: amplifying the output signals; converting the amplified output signals into digital values; generating temperature values corresponding to the digital values; and generating the first temperature data by matching the temperature values with locations of sensing regions corresponding to the selected temperature sensors.

The method may further include: storing a lowest digital value corresponding to a lowest temperature value and a highest digital value corresponding to a highest temperature value; and calculating the temperature values based on the digital values, the lowest temperature value, the lowest digital value, the highest temperature value, and the highest digital value.

The method may further include performing at least one of an image sticking compensation (ISC) and a real-time gamma correction (RGC) by using the first temperature data.

Another aspect is an OLED display, comprising a display panel including a plurality of pixels and a plurality of sensing regions; a temperature sensor array comprising a plurality of temperature sensors respectively arranged on the sensing regions; and a controller configured to i) output a plurality of control signals so as to sequentially select the temperature sensors, ii) receive a plurality of output signals output from the temperature sensors selected by the control signals, and iii) generate first temperature data corresponding to the locations of the selected temperature sensors based on the output signals.

The OLED display can further comprise an amplifier configured to i) amplify the output signals output from the temperature sensors and ii) output the amplified output signals to the controller. Each of the temperature sensors can comprise a temperature variable resistor that has a resistance value configured to be changed according to temperature. The OLED display can further comprise a switch array including a plurality of switches that are i) respectively connected to the temperature sensors and ii) configured to be turned on/turned off by the control signals. The OLED display can further comprise a power supply configured to supply a constant voltage to the temperature sensor array, wherein the switch array further includes a fixed resistor connected to the switches and having a substantially constant resistance value and wherein each of the output signals corresponds to a magnitude of a voltage across a corresponding one of the temperature sensors selected by the control signals.

The OLED display can further comprise a power supply configured to supply a constant current to the temperature sensor array, wherein each of the output signals corresponds to a magnitude of a voltage across a corresponding one of the temperature sensors selected by the control signals. The controller can be further configured to output the control signals so as to select the temperature sensors in a predetermined order. The display panel can further include a plurality of intermediate regions arranged between the sensing regions and the controller can be further configured to generate second temperature data corresponding to the intermediate regions based on the first temperature data.

The OLED display can further comprise an amplifier configured to amplify the output signals, wherein the controller is further configured to i) receive the amplified output signals output from the amplifier, ii) convert the amplified output signals into digital values, iii) generate temperature values corresponding to the digital values, and iv) match the temperature values with the locations of sensing regions corresponding to the selected temperature sensors so as to generate the first temperature data. The OLED display can further comprise a memory configured to store a lowest digital value corresponding to a lowest temperature value and a highest digital value corresponding to a highest temperature value, wherein the controller is further configured to calculate the temperature value based on the digital values, the lowest temperature value, the lowest digital value, the highest temperature value, and the highest digital value.

The temperature sensory array can further comprise a first flexible printed circuit board (FPCB) base film attached to a rear surface of the display panel; a plurality of thermistors arranged on the first FPCB base film; and a second FPCB base film formed over the first FPCB base film so as to cover the thermistors. The OLED display can further comprise a correcting unit configured to perform at least one of an image sticking compensation (ISC) and a real-time gamma correction (RGC) based on the first temperature data.

Another aspect is a method of driving an OLED display comprising a display panel including a plurality of pixels and a plurality of sensing regions, the method comprising outputting a plurality of control signals so as to sequentially select a plurality of temperature sensors that are respectively arranged on the sensing regions; receiving a plurality of output signals output from the temperature sensors selected by the control signals; and generating first temperature data corresponding to the locations of the selected temperature sensors based on the output signals.

Each of the temperature sensors can comprise a temperature variable resistor and wherein the temperature sensors are configured to be selectively activated by the control signals. The method can further comprise supplying electric power to the temperature sensors; and the control signals turning on/turning off a plurality of switches that are respectively connected to the temperature sensors, wherein each of the output signals corresponds to a magnitude of a voltage across a corresponding one of the temperature sensors selected by the control signals. The method can further comprise the control signals selecting the temperature sensors in a predetermined order.

The display panel can further include a plurality of intermediate regions arranged between the sensing regions and the method can further comprise generating second temperature data corresponding to the intermediate regions based on the first temperature data. The method can further comprise amplifying the output signals; converting the amplified output signals into digital values; generating temperature values corresponding to the digital values; and matching the temperature values with the locations of sensing regions corresponding to the selected temperature sensors so as to generate the first temperature data.

The method can further comprise a memory storing a lowest digital value corresponding to a lowest temperature value and a highest digital value corresponding to a highest temperature value; and calculating the temperature values based on the digital values, the lowest temperature value, the lowest digital value, the highest temperature value, and the highest digital value. The method can further comprise performing at least one of an image sticking compensation (ISC) and a real-time gamma correction (RGC) based on the first temperature data.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION OF CERTAIN INVENTIVE EMBODIMENTS

Figure 1:
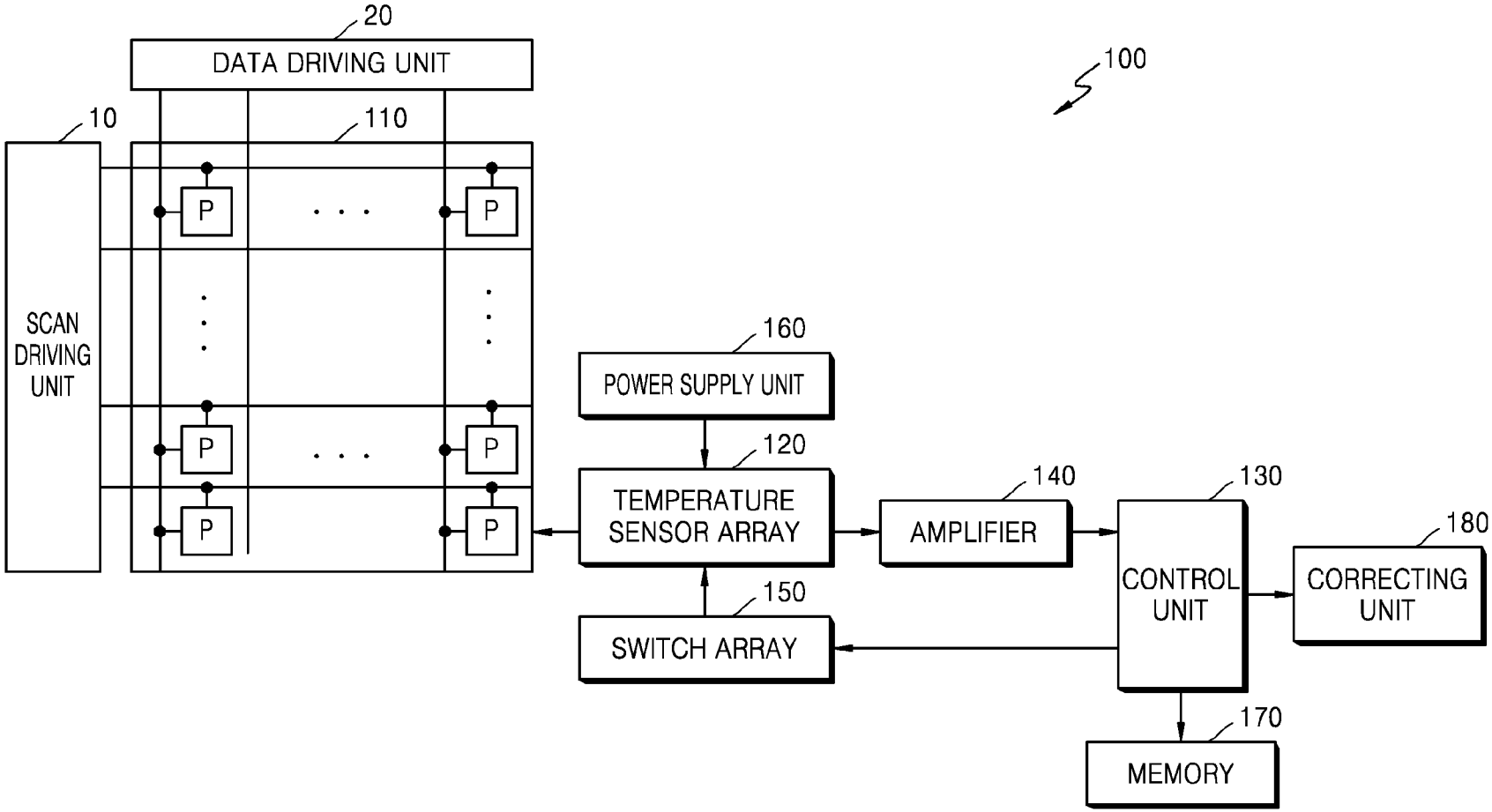
FIG. 1 is a block diagram of an OLED display according to an embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

As the described technology allows for various changes and numerous embodiments, particular embodiments will be illustrated in the drawings and described in detail in the written description. The described technology will now be described more fully hereinafter with reference to the accompanying drawings, in which illustrative embodiments are shown. The described technology, however, be embodied in many different forms and should not be construed as limited to the embodiments set forth herein.

Hereinafter, the described technology will be described in detail by explaining embodiments with reference to the attached drawings. Like reference numerals in the drawings denote like elements.

It will be understood that although the terms "first," "second," etc. may be used herein to describe various components, these components should not be limited by these terms. These components are only used to distinguish one component from another.

As used herein, the singular forms "a," "an" and "the" are intended to include the plural forms as well, unless the context clearly indicates otherwise.

It will be further understood that the terms "comprises" and/or "comprising" used herein specify the presence of stated features or components, but do not preclude the presence or addition of one or more other features or components.

It will be understood that when a layer, region, or component is referred to as being "formed on" another layer, region, or component, it can be directly or indirectly formed on the other layer, region, or component. That is, for example, intervening layers, regions, or components may be present.

The sizes of components in the drawings may be exaggerated for the sake of clarity. In other words, since the sizes and thicknesses of components in the drawings may be exaggerated for the sake of clarity, the following embodiments are not limited thereto.

FIG. 1 is a block diagram of an OLED display 100 according to an embodiment.

Referring to FIG. 1, the OLED display 100 includes a scan driving unit or scan driver 10, a data driving unit or data driver 20, a display unit or display panel 110, a temperature sensor array 120, a control unit or controller 130, an amplifier 140, a switch array 150, a power supply unit or power supply 160, a memory 170, and a correcting unit 180.

The scan driving unit 10 applies scan signals to rows of pixels P on the display unit 110.

The data driving unit 20 applies data voltages to pixels P selected by the scan driving unit 10.

The display unit 110 includes a plurality of pixels P. Although not shown in FIG. 1, each of the pixels P on the display unit 110 can include a switching transistor, a driving transistor, a capacitor, and an OLED. The switching transistor can be turned on by the signal applied from the scan driving unit 10. A gate electrode of the driving transistor is electrically connected to the data driving unit 20 and a gate voltage of the driving transistor can be determined according to the data voltage applied by the data driving unit 20. The magnitude of electric current flowing in the OLED can be determined based on the magnitude of the gate voltage of the driving transistor and the luminance of the OLED can be controlled by controlling the magnitude of the electric current flowing in the OLED.

The display unit 110 can include a plurality of sensing regions and a plurality of intermediate regions. Each sensing region may be a region, the temperature of which is sensed by a temperature sensor. The intermediate region may be a region, the temperature of which is not sensed by a temperature sensor. The intermediate regions can be located between the sensing regions; however, the described technology is not limited thereto. Each of the sensing regions and each of the intermediate regions may respectively include one of the pixels P formed on the display unit 110 or a group of a plurality of pixels; however, the described technology is not limited thereto.

The sensing regions may be arranged in a predetermined shape in the display unit 110. For example, the sensing regions may be arranged in a matrix, a honeycomb shape, or a triangle shape.

The temperature sensor array 120 may include a plurality of temperature sensors respectively corresponding to the sensing regions defined on the display unit 110. The temperature sensors may be respectively arranged on corresponding sensing regions; however, the described technology is not limited thereto.

The temperature sensors may be arranged in a predetermined shape in the temperature sensor array 120. For example, the temperature sensors may be arranged in a matrix, a honeycomb shape, or a triangle shape.

Each of the temperature sensors may include a temperature variable resistance, that is, a device having a resistance value that varies depending on temperature, for example, a thermistor. For example, the resistance value of the temperature variable resistance may increase when the temperature rises. As another example, the resistance value of the temperature variable resistance decrease when the temperature rises.

The temperature sensor array 120 may include a plurality of temperature sensors that are arranged in parallel with each other. The temperature sensors may be electrically connected to each other. For example, an end of each of the temperature sensors may be connected to a node and the other end of each of the temperature sensors may be connected to a switch of the switch array 150. Here, a control signal for selecting one temperature sensor from among the plurality of temperature sensors is input to a switch that is connected to the one temperature sensor, and then, the switch is shorted by the control signal. Thus, the temperature sensors may work selectively in a predetermined order according to the control signal.

The temperature sensors that are electrically connected to each other may receive a constant source (for example, a constant voltage or a constant current) from the power supply unit 150. A plurality of output signals respectively output from the temperature sensors that are electrically connected to each other can be amplified by an amplifier 140.

The temperature sensor array 120 may include a plurality of flexible printed circuit board (FPCB) base films and a plurality of thermistors arranged between the FPCB base films. The temperature sensor array 120 may cover all pixels P of the display unit 110, but is not limited thereto. The temperature sensor array 120 can be attached to a rear surface of the display unit 110, but is not limited thereto.

The temperature sensor array 120 can be formed on a partial area of the pixel circuit of the display unit 110, but is not limited thereto.

The control unit 130 outputs a control signal for selecting one of the temperature sensors included in the temperature sensor array 120. For example, if the temperature sensor array 120 includes first through n-th temperature sensors, the control unit 130 can sequentially output control signals for respectively selecting the first through n-th temperature sensors.

The control unit 130 receives an output signal output from the temperature sensor selected by the control signal. The control unit 130 receives the output signal that is amplified by the amplifier 140. The output signal corresponds to the magnitude of a voltage across the temperature sensor selected by the control signal.

The control unit 130 generates temperature data corresponding to the location of the temperature sensor selected by the control signal based on the output signal. The control unit 130 converts the amplified output signal to a digital value, generates a temperature value corresponding to the digital value, and matches the temperature value with the location of the temperature sensor selected by the control signal to generate first temperature data.

The control unit 130 can convert the output signal that is an analog signal into the digital value. The digital value ADC_Temp_RealTime obtained by converting the output signal can denote a value sensed by the temperature sensor array 120.

The control unit 130 generates the temperature value corresponding to the digital value ADC_Temp_RealTime by using a lowest temperature value Temp_init, a lowest digital value ADC_Temp_init, a highest temperature value Temp_sat, and a highest digital value ADC_Temp_sat stored in the memory 170.

The control unit 130 generates the first temperature data by matching the temperature value with the location of the temperature sensor selected by the control signal and generates second temperature data from the first temperature data. The control unit 130 updates a temperature map by using the first and second temperature data. The first temperature data can denote temperature data corresponding to the sensing region and the second temperature data can denote temperature data corresponding to the intermediate region. The control unit 130 represents temperatures of all the pixels P included in the display unit 110 by using the first and second temperature data.

The control unit 130 outputs the first and second temperature data to the correcting unit 180.

The amplifier 140 amplifies the output signals output from the temperature sensors included in the temperature sensor array 120 and outputs the amplified output signals to the control unit 130. The amplifier 140 amplifies the output signal output from the temperature sensor selected by the control signal. In some embodiments, the temperature sensor array 120 sequentially receives the control signals for selecting the first through n-th temperature sensors and the amplifier 140 sequentially amplifies first through n-th output signals that are sequentially output from the first through n-th temperature sensors. In contrast to when the output signals from the temperature sensors are respectively amplified by a plurality of amplifiers (for example, operational amplifiers (OPAMP)), the amplifier 140 according to at least one embodiment includes only one amplifier, and thus, temperature sensing variation generated due to variations in the gain characteristics of the amplifiers can be removed. The gain resistance of the amplifier 140 may include a micro resistance having a low temperature coefficient.

The switch array 150 includes a plurality of switches that are respectively connected to ends of the temperature sensors included in the temperature sensor array 120. Opening/closing states of the switches can be determined by the control signals. For example, when the temperature sensor array 120 sequentially receives the control signals for selecting the first through n-th temperature sensors, first through n-th switches that are respectively connected to ends of the first through n-th temperature sensors are sequentially turned on/turned off.

The switches included in the switch array 150 may be n-channel metal-oxide-semiconductor field-effect transistors (MOSFETs) or p-channel MOSFETs, but are not limited thereto. The n-channel MOSFET or the p-channel MOSFET receives the control signal via a gate electrode.

An end of each of the switches included in the switch array 150 is connected to the other end of each of the temperature sensors included in the temperature sensor array 120 and the other end of each of the switches in the switch array 150 is connected to a fixed resistor Rfix having a constant resistance value. For example, the other ends of the switches and an end of the fixed resistor Rfix can be connected to one node. The fixed resistor Rfix forms a voltage distributor with the temperature sensor of the temperature sensor array 120 and may be a micro resistance having a high temperature coefficient.

The switch array 150 may be controlled by a dummy channel in an internal circuit of the scan driving unit 10 or the data driving unit 20. Here, the dummy channel of the scan driving unit 10 denotes remaining channels that are not used for outputting scan signals in order to drive the pixels P. The dummy channel of the data driving unit 20 denote remaining channels that are not used for outputting data voltages in order to drive the pixels P.

The switch array 150 can be arranged as an active matrix between the temperature sensor array 120 and the power supply unit 160, but is not limited thereto.

The power supply unit 160 supplies a constant power to the temperature sensor array 120, that is, the power supply unit 160 supplies a constant current or a constant voltage.

When the power supply unit 160 supplies the constant current, the output signal output from the temperature sensor array 120 may correspond to a magnitude of the voltage between the opposite ends of the temperature sensor selected by the control signal.

When the power supply unit 160 supplies a constant voltage, the output signal output from the temperature sensor array 120 corresponds to a magnitude of the voltage across the temperature sensor selected by the control signal. For example, the power supply unit 160 supplies the constant voltage to the temperature sensor selected by the control signal and the fixed resistor Rfix serially connected to the temperature sensor, and the output signal output from the temperature sensor array 120 corresponds to the magnitude of the voltage between the opposite ends of the temperature sensor, wherein the voltage is distributed by the fixed resistor Rfix.

The memory 170 stores the lowest temperature value Temp_init, the lowest digital value ADC_Temp_init corresponding to the lowest temperature value Temp_init, the highest temperature value Temp_sat, and the highest digital value ADC_Temp_sat corresponding to the highest temperature value Temp_sat of the OLED display 100. The lowest temperature value Temp_init and the highest temperature value Temp_sat can be measured by controlling a heating plate prior to distribution of the OLED display 100 to the market.

The memory 170 stores a lookup table with respect to the digital values.

The correcting unit 180 corrects temperatures by using the temperature data.

The temperature data includes the first and second temperature data output from the control unit 130.

The temperature correction may generally refer to at least one of image sticking compensation (ISC) and real-time gamma correction (RGC), but is not limited thereto. The correcting unit 180 executes ISC or RGC in order to correct differences in the optical characteristics of the pixels due to temperature dispersion over the surface of the display unit 110.

Hereinafter, one or more embodiments will be described below with reference to FIGS. 2 and 3.

Figure 2:
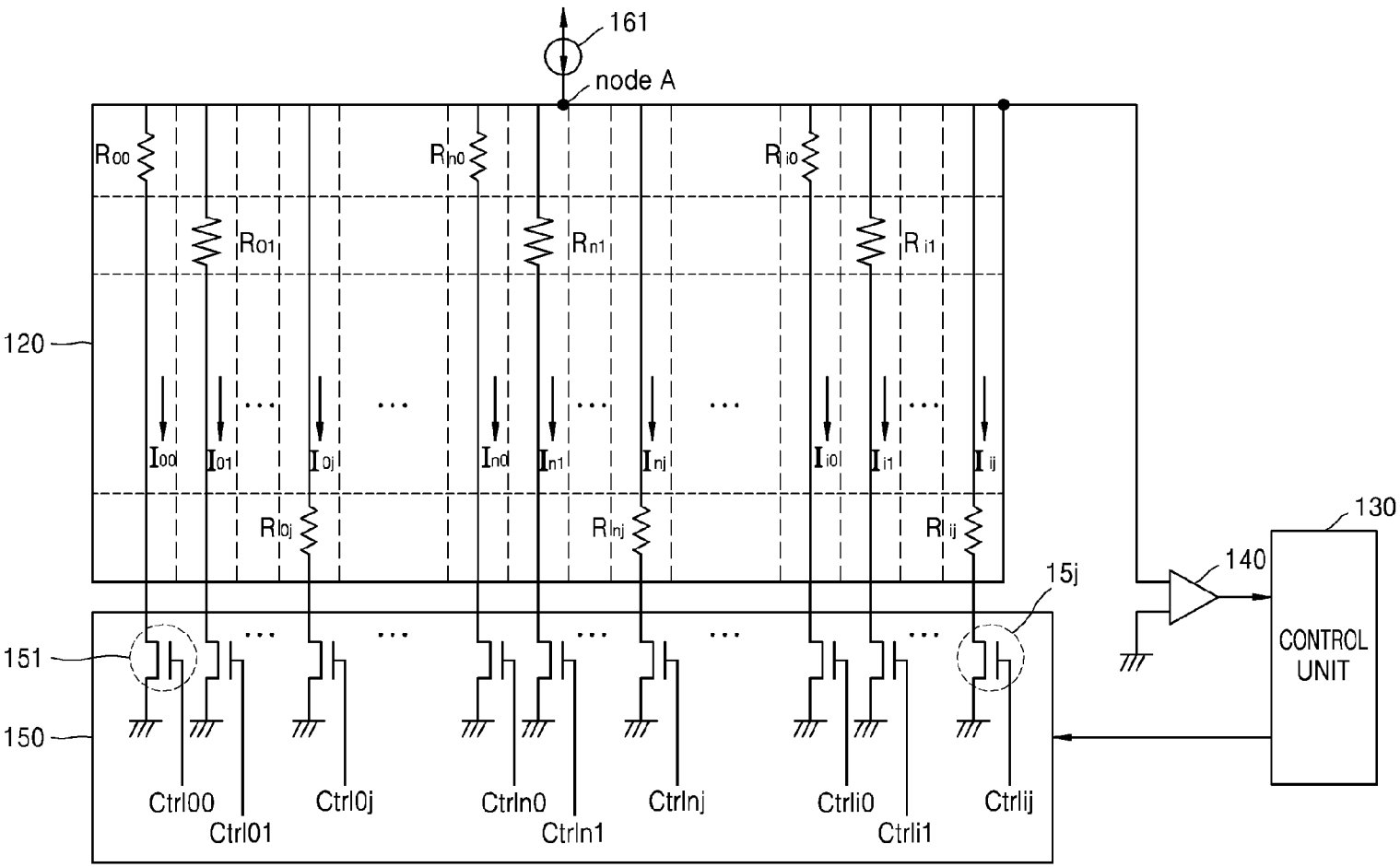
FIG. 2 is a circuit diagram of an OLED display according to an embodiment.

FIG. 2 is a circuit diagram of the OLED display 100 according to an embodiment.

Referring to FIG. 2, the temperature sensors included in the temperature sensor array 120 are arranged to correspond respectively to the sensing regions. In some embodiments, the temperature sensor array 120 is attached to the rear surface of the display unit 110.

A power supply unit 161 supplies a constant current to the temperature sensor array 120.

The control unit 130 generates control signals Ctrl00-Ctrlij for selecting temperature sensors from among the temperature sensors included in the temperature sensor array 120 and outputs the control signals Ctrl00-Ctrlij to the switch array 150. For example, the control unit 130 generates the control signal Ctrl00 for selecting a first temperature sensor R00 and outputs the control signal Ctrl00 to a first switch 151.

The switch array 150 receives the control signals Ctrl00-Ctrlij, and then, a switch connected to one temperature sensor is turned on according to the control signal. For example, when the switch array 150 receives the control signal Ctrl00 for selecting the first temperature sensor R00, the first switch 151 connected to the first temperature sensor R00 is turned on.

The temperature sensor array 120 outputs an output signal corresponding to the magnitude of the voltage across the temperature sensor selected by the control signal. For example, the output signal corresponds to the magnitude of the voltage applied to the opposite ends of the first temperature sensor R00 by a first current TOO supplied to the first temperature sensor R00.

The amplifier 140 amplifies the output signal output from the temperature sensor array 120 and transmits the output signal to the control unit 130.

For example, the control unit 130 generates the control signals Ctrl00-Ctrlij for selecting the temperature sensors and outputs the control signals to the switch array 150. The switch array 150 receives the control signals Ctrl00-Ctrlij and the switches are controlled by the control signals Ctrl00-Ctrlij. Then, the temperature sensors included in the temperature sensor array 120 are sequentially selected one-by-one, and thus, a closed circuit including the selected temperature sensor s formed between the current supply unit 161 and a ground. The selected temperature sensor has a resistance value that is in proportional to (or inverse-proportional to) the selected temperature sensor's temperature and the voltage drops in the selected temperature sensor due to the current supplied from the current supply unit 161. The selected temperature sensor outputs the output signal corresponding to the voltage across the selected temperature sensor (that is, a voltage dropping amount) and the control unit 130 receives the output signal and determines the temperature value of the selected temperature sensor based on the output signal.

Figure 3:
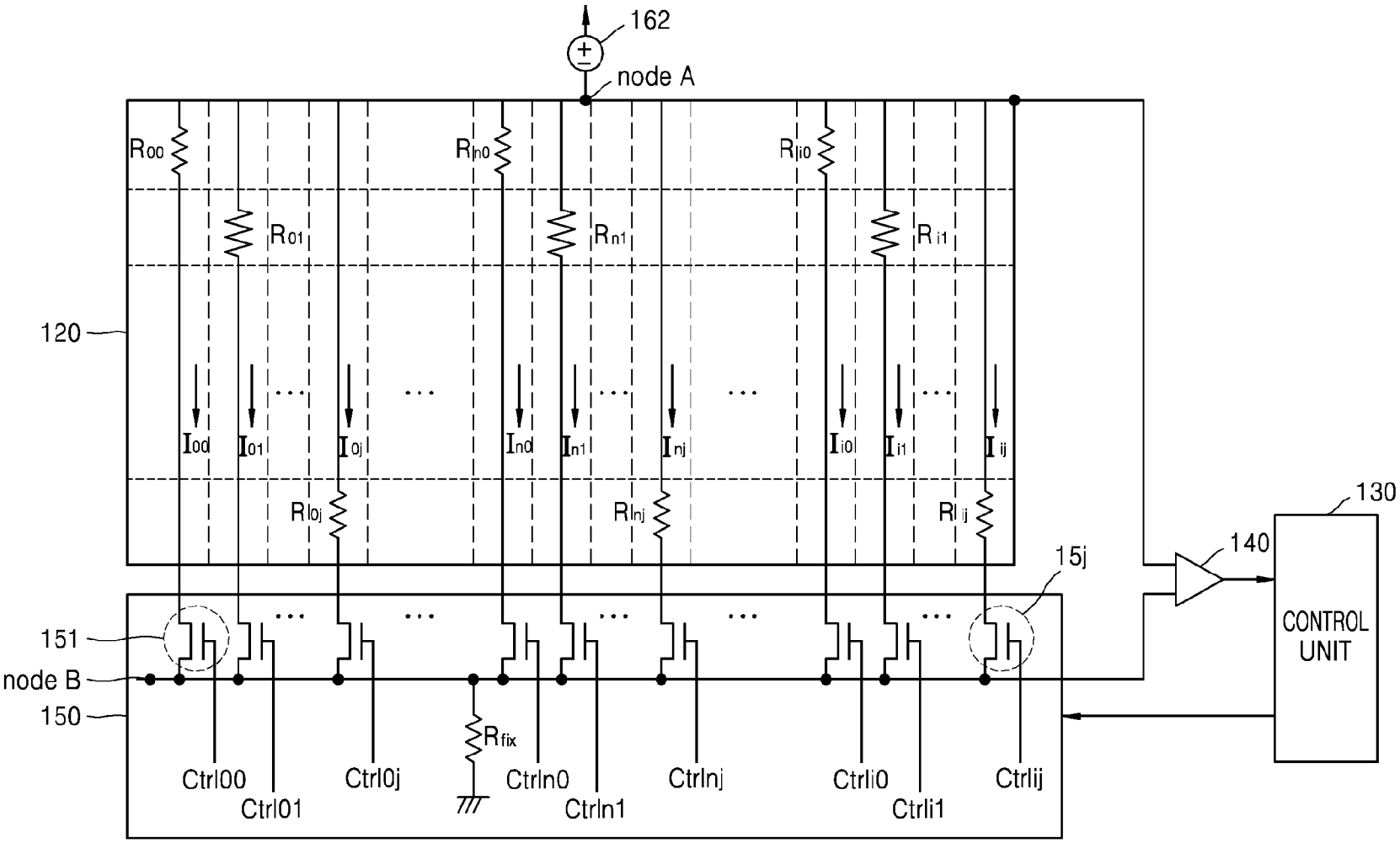
FIG. 3 is a circuit diagram of an OLED display according to another embodiment.

FIG. 3 is a circuit diagram exemplary showing the OLED display according to another embodiment.

Referring to FIG. 3, a voltage supply unit 162 applies a constant voltage to the temperature sensor array 120.

The control unit 130 generates the control signals Ctrl00-Ctrlij for selecting the temperature sensors from among the temperature sensors included in the temperature sensor array 120. For example, the control unit 130 generates the control signal Ctrl00 for selecting the first temperature sensor R00 and outputs the control signal Ctrl00 to the first switch 151.

The switch array 150 receives the control signals Ctrl00-Ctrlij and a switch connected to one temperature sensor is turned on according to the control signal. For example, if the switch array 150 receives the control signal Ctrl00 for selecting the first temperature sensor R00, the first switch 151 connected to the first temperature sensor R00 is turned on.

The temperature sensor array 120 outputs an output signal corresponding to the magnitude of the voltage between the opposite ends of the temperature sensor selected by the control signal. For example, the output signal may correspond to the magnitude of the voltage between the opposite ends of the first temperature sensor R00. Here, the constant voltage applied from the voltage supply unit 162 can be distributed to the first temperature sensor R00 having an end connected to a node A and the other end connected to a node B, and the fixed resistor Rfix having an end connected to the node B, where the other end connected to the node B is grounded.

The amplifier 140 amplifies the output signal output from the temperature sensor array 120 and transmits the output signal to the control unit 130.

For example, the control unit 130 generates the control signals Ctrl00-Ctrlij for selecting the temperature sensors and outputs the control signals Ctrl00-Ctrlij to the switch array 150. The switch array 150 receives the control signals Ctrl00-Ctrlij and the switches in the switch array 150 are controlled by the control signals Ctrl00-Ctrlij. Then, the temperature sensors in the temperature sensor array 120 are selected sequentially one-by-one and a closed circuit including the selected temperature sensor is formed between the voltage supply unit 162 and the ground. The selected temperature sensor has a resistance value that is proportional to (or inverse-proportional to) the temperature and voltage dropping occurs in the selected temperature sensor and the fixed resistor Rfix due to the voltage supplied from the voltage supply unit 162. The selected temperature sensor outputs an output signal corresponding to the voltage between the opposite ends (that is, a voltage dropping amount), and the control unit 130 receives the output signal and determines the temperature value of the selected temperature sensor based on the output signal.

Hereinafter, a temperature sensor according to an embodiment will be described with reference to FIGS. 4 and 5.

Figure 4:
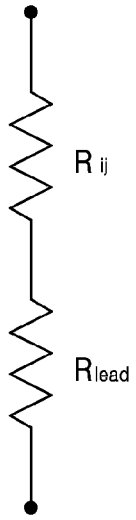
FIG. 4 is a diagram of a temperature sensor according to an embodiment.

FIG. 4 is a diagram illustrating the temperature sensor according to an embodiment. FIG. 5 is a graph describing an operation of the temperature sensor according to an embodiment.

Referring to FIG. 4, the temperature sensor arranged on the sensing region of the display unit 110 includes a thermistor resistor $R_{ij}$ and a lead resistor $R_{lead}$. The lead resistor $R_{lead}$ may have a resistance value that is in the range of about tens to hundreds of mΩ, which is much less than that of the thermistor resistor $R_{ij}$ that is in the range of about tens to hundreds of kΩ.

Figure 5:
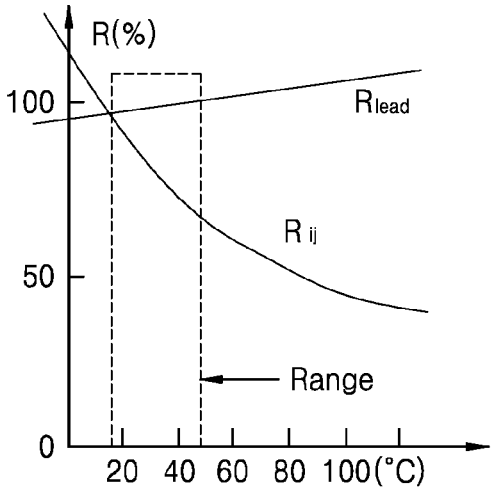
FIG. 5 is a diagram illustrating operations of the temperature sensor of FIG. 4.

Referring to FIG. 5, within a range of driving the pixels of a display panel, when the temperature rises, the resistance of the thermistor resistor $R_{ij}$ rapidly decreases, whereas the resistance of lead resistor $R_{lead}$ gradually increases. As described above, when the temperature coefficient of the lead resistor $R_{lead}$ is reduced, a high accuracy of temperature measurement can be ensured.

The temperature sensors may have the same lengths as each other so as to have the same lead resistor $R_{lead}$ resistance value.

Figure 6:
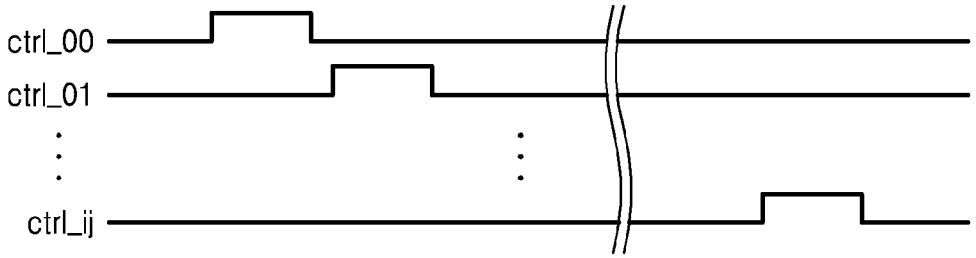
FIG. 6 is a diagram of a control signal according to an embodiment.

FIG. 6 is a diagram of a control signal according to an embodiment.

Referring to FIG. 6, the control unit 130 generates the control signals for selecting one of the temperature sensors in the temperature sensor array 120, in a predetermined order.

For example, the control unit 130 can generate the control signals Ctrl00-Ctrlij for sequentially selecting first through j-th temperature sensors R00-Rij.

Here, the switch array 150 can sequentially turn on the first through j-th switches 151 through 15*j* that are respectively connected to the first through j-th temperature sensors R00 through Rij, according to the control signals Ctrl00-Ctrlij for respectively selecting the first through j-th temperature sensors R00 through Rij.

The amplifier 140 sequentially amplifies the output signals corresponding to the magnitude of the voltage between the opposite ends of the first through j-th temperature sensors R00 through Rij, and then, transmits the amplified output signals to the control unit 130.

Figure 7:
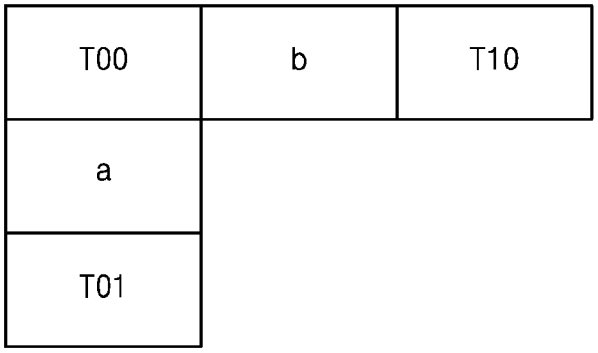
FIG. 7 is a diagram for describing temperature data according to an embodiment.

FIG. 7 is a diagram illustrating temperature data according to an embodiment.

Referring to FIG. 7, the control unit 130 generates second temperature data corresponding to the intermediate regions based on the first temperature data corresponding to the sensing regions.

For example, the control unit 130 can generate the second temperature data a and b based on the first temperature data T00, T01, and T10 by using equations 1 and 2.

$$a = \frac{(T00 + T01)}{2} \tag{1}$$

$$b = \frac{(T00 + T10)}{2} \tag{2}$$

Figure 8:
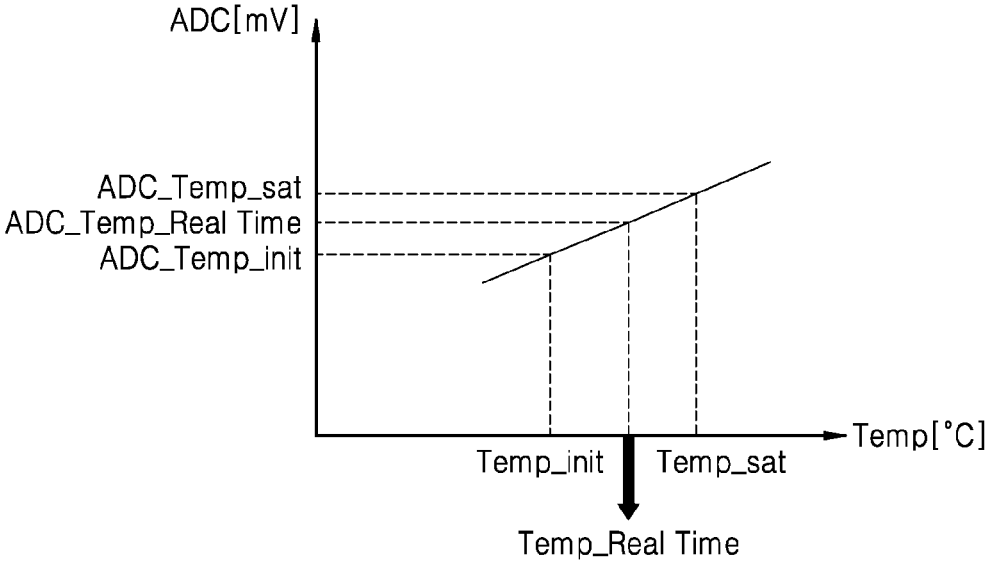
FIG. 8 is a diagram for describing temperature values according to an embodiment.

FIG. 8 is a graph of temperature values, according to an embodiment.

Referring to FIG. 8, the control unit 130 generates a temperature value corresponding to a digital value ADC_Temp_RealTime that is converted from the lowest temperature value Temp_init, the lowest digital value ADC_Temp_init, the highest temperature value Temp_sat, and the highest digital value ADC_Temp_sat by using equation 3.

$$\text{Temp_RealTime} = \text{Temp_init} + (\text{Temp_sat} - \text{Temp_init}) \frac{(\text{ADC_Temp_RealTime} - \text{ADC_Temp_init})}{(\text{ADC_Temp_sat} - \text{ADC_Temp_init})} \tag{3}$$

When the digital value ADC_Temp_RealTime is converted from the output signal, the control unit 130 can generate the temperature value that is linearly interpolated by using equation 3 or can generate the temperature value corresponding to the converted digital value ADC_Temp_RealTime by using a lookup table including the digital values corresponding to the temperature values stored in the memory 170 in advance. However, the described technology is not limited thereto.

Figure 9:
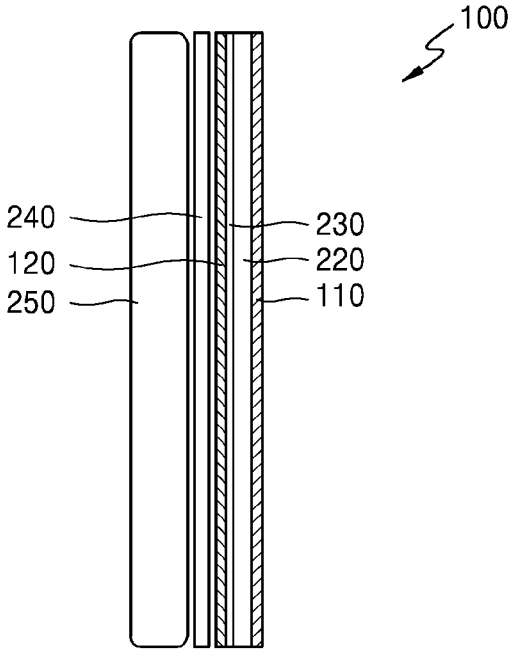
FIGS. 9 through 11 are diagrams showing the structure of an OLED display according to an embodiment.
Figure 10:
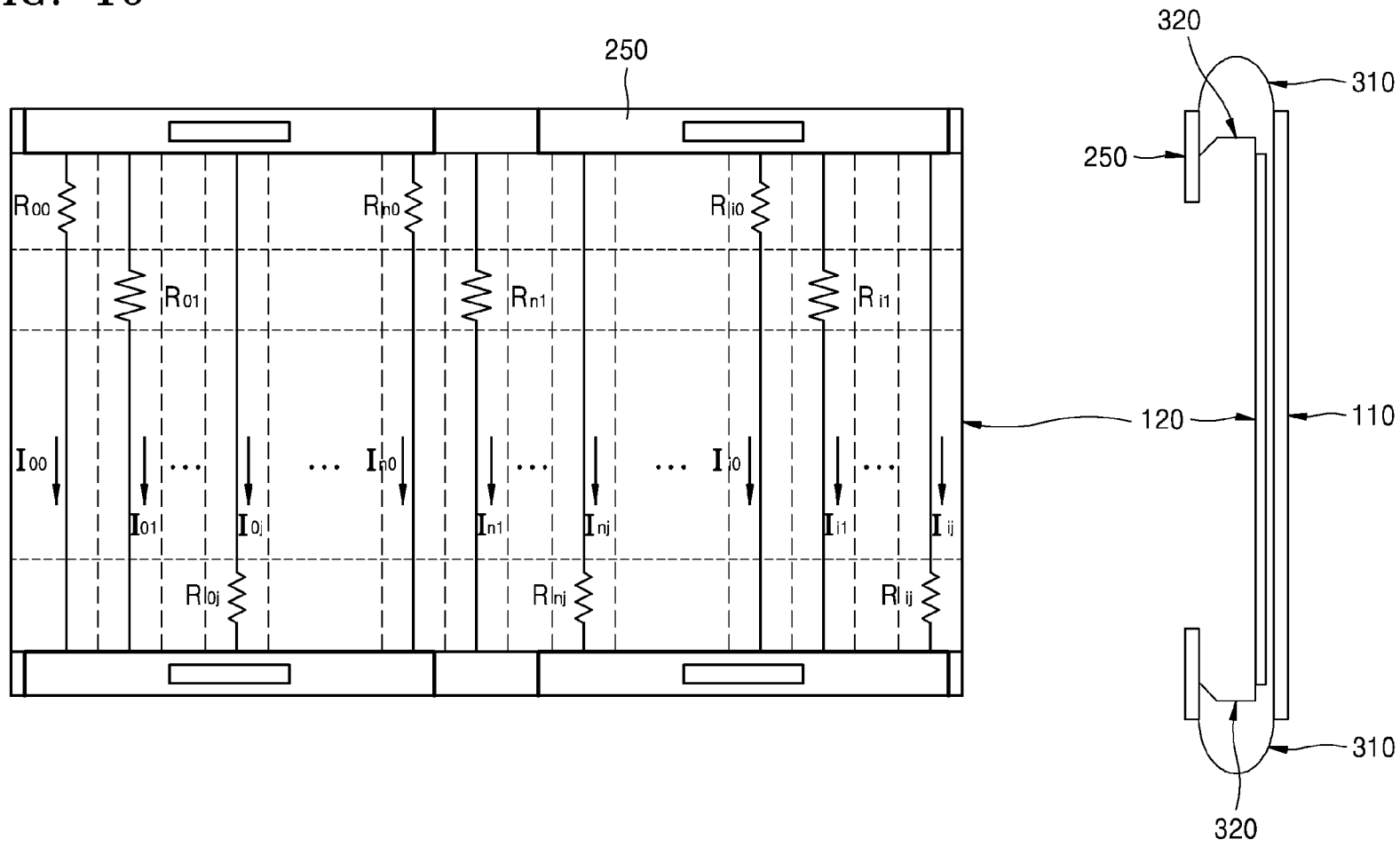
Figure 11:
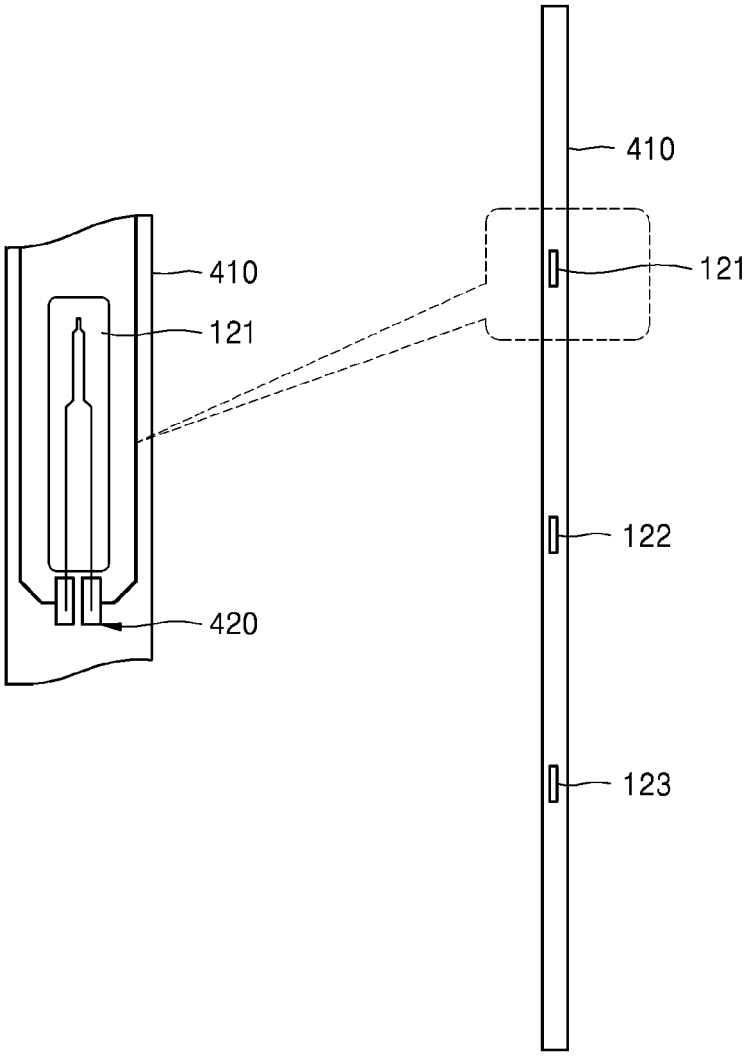

FIGS. 9 through 11 are diagrams of the OLED display 100 according to another embodiment.

Referring to FIG. 9, the OLED display 100 includes the display unit 110, a heat dissipation sheet 220, a thermal conductive adhesive sheet 230, the temperature sensor array 120, a metal chassis 240, and a substrate 250 that are overlaid.

The display unit 110 may be an OLED panel.

The heat dissipation sheet 220 is attached to the rear surface of the display unit 110 so that the heat generated by the display unit 110 can be transferred to the metal chassis 240 on a rear surface thereof. The heat dissipation sheet 220 may have a size that is equal to or greater than that of the OLED panel to be overlaid on the entire rear surface of the OLED panel, but is not limited thereto. The heat dissipation sheet may be substituted with a dispersion sheet which may include a material having high thermal conductance (for example, graphite).

The temperature sensor array 120, having a substantially film shape, is attached to a rear surface of the heat dissipation sheet 220 via the thermal conductive adhesive sheet 230. The temperature sensor array 120 may have a size that is equal to that of the OLED panel to be overlaid on the entire rear surface of the OLED panel, but is not limited thereto. The temperature sensor array 120 of the film type has no limitation to the number of temperature sensors and the locations of the temperature sensors for sensing the temperature of the display unit 110, and thus, a temperature map can be extracted easily.

The metal chassis 240 is arranged on the rear surface of the temperature sensor array 120 and receives and radiates the heat from the display unit 110. The metal chassis 240 may have a size that is equal to or greater than that of the temperature sensor array 120 to be overlaid on the entire rear surface of the temperature sensor array 120, but is not limited thereto.

The substrate 250 is arranged on a rear surface of the metal chassis 240. The substrate 250 is located on a rear surface of the display unit 110 to control driving of the display unit 110 and to supply electric power. The substrate 250 may be a printed circuit board (PCB).

Referring to FIG. 10, the rear surface of the display unit 110 contacts a surface of the temperature sensor array 120. The size of the switch array 150 may be equal to the screen size of the display unit 110, but is not limited thereto. The display unit 110 can be connected to the substrate 250 that is located on at least one of an upper end and a lower end of the rear surface of the display unit 110 via a data integrated chip/electro luminescence (IC/EL) film 310. The temperature sensor array 120 can be connected to the substrate 250 via a cable 320. The data IC/EL film 310 and the cable 320 can be formed as supports between the display unit 110 and the substrate 250 and between the temperature sensor array 120 and the substrate 250.

The power supply unit 160 and the switch array 150 are formed on the substrate 250 located on upper and lower portions of the rear surface of the display unit 110, and can be connected to the temperature sensor array 120 via the cable 320.

Referring to FIG. 11, a plurality of temperature sensors 121, 122, and 123 included in the temperature sensor array 120 can be attached to a first FPCB base film 410 via solder 420. A second FPCB base film (not shown) covering the temperature sensors 121, 122, and 123 may be arranged on the first FPCB base film 410. The first FPCB base film 410 is a base film for manufacturing the FPCB.

Although not denoted by reference numerals, wires may connect the temperature sensors 121, 122, and 123 included in the temperature sensor array 120 to corresponding switches in the switch array 150.

According to one or more embodiments, the electric characteristics of the OLED display can be improved through precise temperature measurement.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope of the invention as defined by the following claims.

What is claimed is:

1. An organic light-emitting diode (OLED) display, comprising:

a display panel including a plurality of pixels and a plurality of sensing regions;

a temperature sensor array comprising a plurality of temperature sensors respectively arranged on the sensing regions; and a controller configured to i) output a plurality of control signals so as to sequentially select the temperature sensors, ii) receive a plurality of output signals output from the temperature sensors selected by the control signals, and iii) generate first temperature data corresponding to the locations of the selected temperature sensors based on the output signals, wherein the temperature sensor array comprises:

a first flexible printed circuit board (FPCB) base film attached to a rear surface of the display panel;

a plurality of thermistors arranged on the first FPCB base film; and a second FPCB base film formed over the first FPCB base film so as to cover the thermistors.

2. The OLED display of claim 1, further comprising an amplifier configured to i) amplify the output signals output from the temperature sensors and ii) output the amplified output signals to the controller.

3. The OLED display of claim 1, wherein each of the temperature sensors comprises a temperature variable resistor that has a resistance value configured to be changed according to temperature.

4. The OLED display of claim 1, further comprising a power supply configured to supply a constant voltage to the temperature sensor array, wherein the switch array further includes a fixed resistor connected to the switches and having a substantially constant resistance value and wherein each of the output signals corresponds to a magnitude of a voltage across a corresponding one of the temperature sensors selected by the control signals.

5. The OLED display of claim 1, further comprising a power supply configured to supply a constant current to the temperature sensor array, wherein each of the output signals corresponds to a magnitude of a voltage across a corresponding one of the temperature sensors selected by the control signals.

6. The OLED display of claim 1, wherein the controller is further configured to output the control signals so as to select the temperature sensors in a predetermined order.

7. The OLED display of claim 1, wherein the display panel further includes a plurality of intermediate regions arranged between the sensing regions and wherein the controller is further configured to generate second temperature data corresponding to the intermediate regions based on the first temperature data.

8. The OLED display of claim 1, further comprising an amplifier configured to amplify the output signals, wherein the controller is further configured to i) receive the amplified output signals output from the amplifier, ii) convert the amplified output signals into digital values, iii) generate temperature values corresponding to the digital values, and iv) match the temperature values with the locations of sensing regions corresponding to the selected temperature sensors so as to generate the first temperature data.

9. The OLED display of claim 8, further comprising a memory configured to store a lowest digital value corresponding to a lowest temperature value and a highest digital value corresponding to a highest temperature value, wherein the controller is further configured to calculate the temperature value based on the digital values, the lowest temperature value, the lowest digital value, the highest temperature value, and the highest digital value.

10. The OLED display of claim 1, further comprising a correcting unit configured to perform at least one of an image sticking compensation (ISC) and a real-time gamma correction (RGC) based on the first temperature data.

* * * * *